US005281898A

United States Patent [19]

Albright

[11] Patent Number: 5,281,898

[45] Date of Patent: Jan. 25, 1994

[54] DISPLAY DEVICE

[76] Inventor: Larry Albright, 419 Sunset Ave., Venice, Calif. 90291

[21] Appl. No.: 697,764

[22] Filed: May 9, 1991

[51] Int. Cl.[5] ..... H01J 17/04

[52] U.S. Cl. ..... 315/326; 315/246; 313/610; 313/613

[58] Field of Search ..... 313/608, 609, 610, 611, 313/613, 634; 315/246, 326; 340/758, 771, 815.15

[56] References Cited

U.S. PATENT DOCUMENTS

| | | | |
|---|---|---|---|
| 1,851,532 | 3/1932 | Vollrath | 313/608 |
| 4,260,931 | 4/1981 | Wesselink et al. | 313/610 |
| 4,311,943 | 1/1982 | Gross et al. | 313/608 |
| 4,956,579 | 9/1990 | Albright | 313/608 |

FOREIGN PATENT DOCUMENTS

| | | | |
|---|---|---|---|
| 0516695 | 1/1932 | Fed. Rep. of Germany | 313/608 |
| 0480020 | 2/1938 | United Kingdom | 313/613 |

*Primary Examiner*—Donald J. Yusko
*Assistant Examiner*—N. D. Patel
*Attorney, Agent, or Firm*—Spensley Horn Jubas & Lubitz

[57] ABSTRACT

A glass cylindrical or spherical double walled enclosure defines a containing envelope for containing an ionized gas discharge among dielectric pellets or beads. The double walls of the enclosure form a torus or hollow cylinder, sphere or other suitable shape and define an enclosed glass discharge area. The gas discharge area is formed by the double walls being filled with an ionizable gas. Electrodes are attached to ends of the enclosure and a constant current transformer is connected for supplying a high voltage sufficient to produce visible discharges in the gas discharge area. The center of the torus, or other suitable shape, is accessible to the outside and allows the application of an electrostatic grounding conductor of metal, or a conventional neon tube which acts as a double duty attracter and illuminator for the background of the display device. Traps are provided between the dielectric pellets and the electrodes to prevent the dielectric pellets from contacting the electrodes.

15 Claims, 3 Drawing Sheets

DISPLAY DEVICE

BACKGROUND OF THE INVENTION

1. Field of the Invention

The present invention relates to gas discharge display devices and methods of making the same.

2. Related Art

Technology involved in the present invention is an outgrowth of the neon sign industry. Early neon tubes, developed around 1909, consisted of a length of glass tubing which was fitted with electrodes at its extreme ends. These tubes were evacuated and back filled with ionizable gasses at lower than atmospheric pressures. These gasses were energized with a high voltage signal from a constant current transformer, the signal being of several thousand volts, alternating current, usually line frequency, for example, 50 or 60 cycles per second. The first tubes were filled with carbon dioxide. However, these tubes had to be recharged every few days because the carbon dioxide tended to break down. The tubes were improved by using rare gasses, such as neon. Neon, with its distinctive red color which pierces fog and haze, quickly became popular for providing a dramatic effect in signs and beacons.

Volrath describes a gas filled tube device, in U.S. Pat. No. 1,851,532 (issued Mar. 29, 1932), wherein a filling material was packed inside a conventional neon tube creating a multiple maze of paths for the discharge to follow. A 60 cycle current turned the discharge off and on forcing it to reestablish a path with each cycle and resulting in a dramatic visual effect. Various structures have been disposed inside gas filled tubes, such as porcelain ribbed dividers or multiple tubes, for creating multiple paths for the discharge to follow.

SUMMARY OF THE DISCLOSURE

The present invention relates to gas discharge display devices and methods of making the same. According to an embodiment of the invention, a transparent enclosure defines a chamber which is filled with rarefied inert gasses such as, but not limited to, neon, argon, krypton, helium, xenon, argon+mercury and neon+mercury, similar to conventional "neon signs". The chamber is also filled with a dielectric filling material such as glass "Raschig rings" or tubing cut or formed into short lengths, glass beads, glass spheres, silica sand, porcelain, or the like. Colored filling material may be used if desired. The operational life of the device can be prolonged by using a dielectric material having extremely low out-gassing characteristics after purification.

Embodiments of the invention are distinguished from prior art devices, including the device described in U.S. Pat. No. 1,851,532, in several respects. For example, embodiments of the invention include improvements in the basic configuration and shape of the gas filled chamber; that is, the chamber is defined between the walls of a double walled enclosure, preferably torus shaped (however, other shapes are considered to be within the scope of the present invention), which provides superior cooling abilities, increases the operational life and enhances the visual appearance of the discharge display. Embodiments include traps to keep the filling material out of the electrodes to help prolong the operational life of the device. Further embodiments include an electrostatic grounding conductor arranged adjacent a wall of the enclosure for drawing the discharge display in a desired direction. Embodiments are made according to processing techniques for very effectively eliminating impurities within the enclosure to help increase the operational life of the device.

BRIEF DESCRIPTION OF THE DRAWINGS

The detailed description of embodiments of the invention will be made with reference to the accompanying drawings, wherein like numerals designate corresponding parts in the several Figures.

DETAILED DESCRIPTION OF THE PREFERRED EMBODIMENTS

The following detailed description is of the best presently contemplated mode of carrying out the invention. This description is not be taken in a limiting sense, but is made merely for the purpose of illustrating general principles of embodiments of the invention. The scope of the invention is best defined by the appended claims.

The present invention relates to gas discharge display devices and methods of making the same. According to embodiments of the invention, a transparent enclosure, such as a glass tube, is filled with an ionizable gas such as an inert gas (e.g., neon, argon, krypton, helium, xenon, argon+mercury, neon+mercury or the like). Dielectric material, such as glass "Raschig rings" or short tubing lengths, glass beads, glass spheres, silica sand, porcelain, or the like, is also disposed in the enclosure. Two electrodes are provided in electrical communication with the gas in the enclosure. An electrical signal source for providing an alternating signal is connected to the electrodes. By applying the alternating signal across the electrodes, the gas is reionized with each cycle of the alternating signal and a visible discharge is caused to reverse direction in each cycle of the alternating signal. With each reversal of direction of the discharge, the discharge establishes a seemingly random new path through the dielectric material. The result is a dramatic lightening-like or crackling visual effect.

According to embodiments of the present invention, this dramatic visual effect is improved by employing a gas enclosure having a shape designed to concentrate the discharge near the outer periphery of the enclosure so as to be more visible. The dramatic visual effect of the discharge is also improved according to embodiments of the invention, by arranging an electrostatic grounding conductor adjacent a wall of the enclosure so as to tailor the discharge towards a preferred direction.

Figure 1:
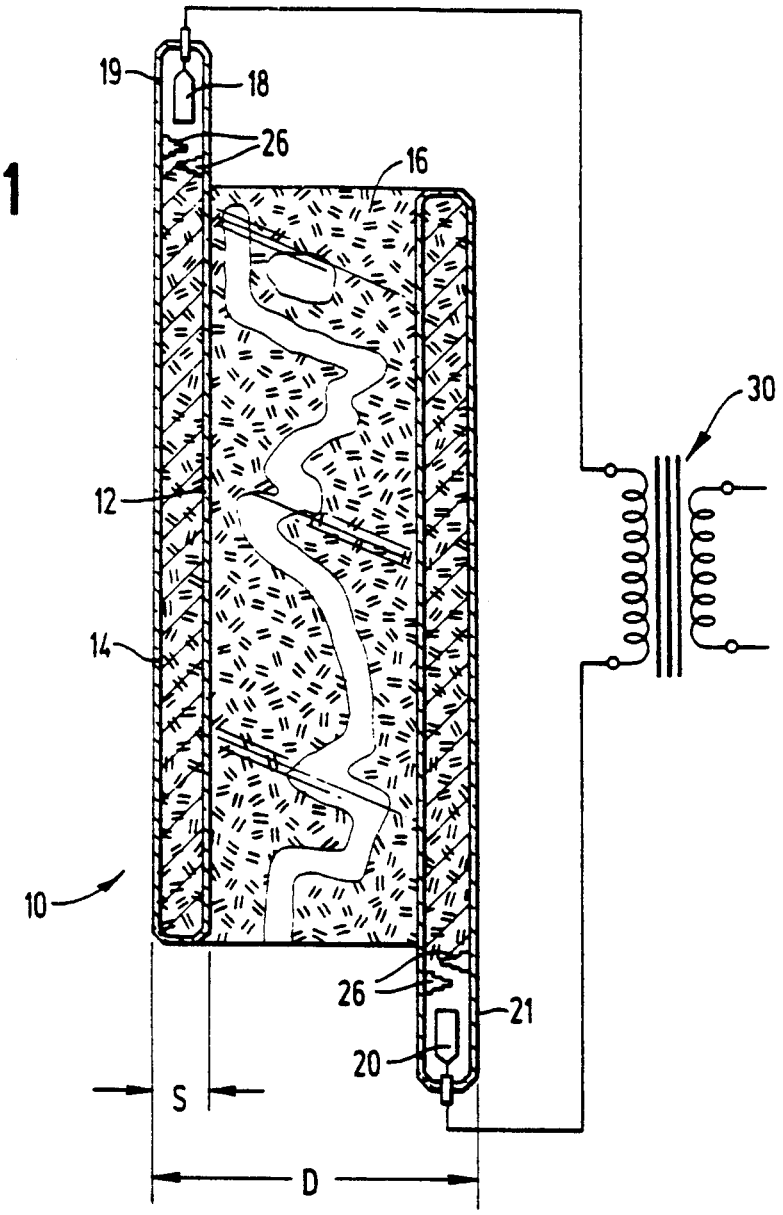
FIG. 1 is a cross section schematic view of an embodiment of the present invention.

FIG. 1 is a cross-section, schematic view of a first embodiment of the invention. Referring to FIG. 1, an enclosure, generally indicated in cross-section at 10, is composed of a double walled hollow cylinder or torus shaped tube. Enclosure 10 has an inner peripheral wall 12 and an outer peripheral wall 14, preferably made of a substantially transparent material, for example, but not limited to, glass.

Figure 6:
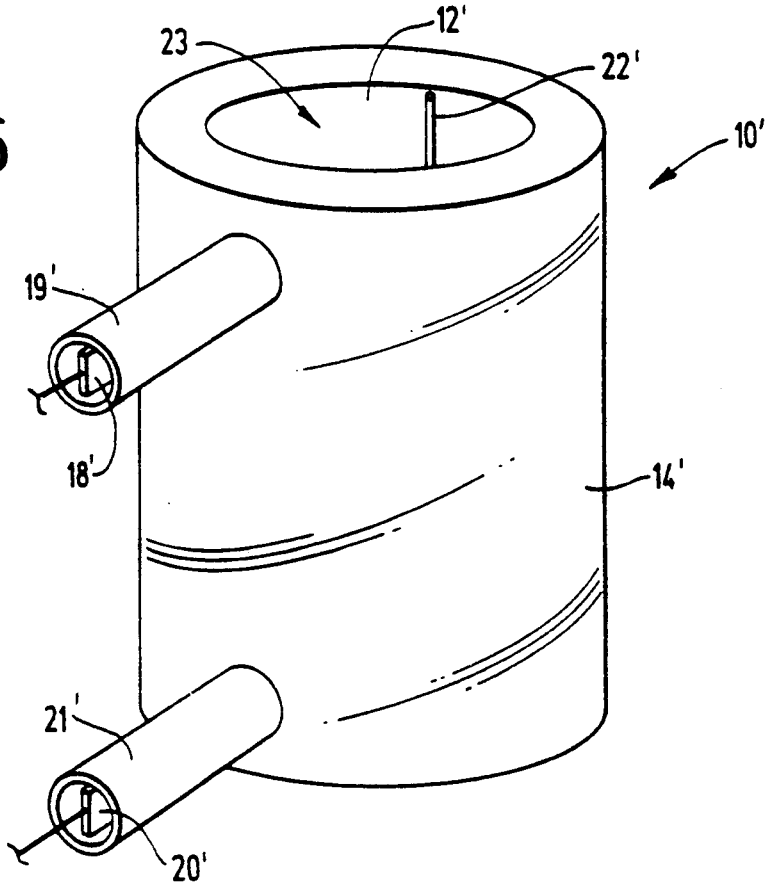
FIG. 6 is an elevated perspective view of an enclosure according to yet another embodiment of the invention.

Dielectric filling material 16 (such as the materials discussed above), and an inert gas (such as the gasses discussed above) are disposed between walls 12 and 14. A pair of electrodes 18 and 20 are arranged in electrical communication with the gas within enclosure 10. In the embodiment shown in FIG. 1, electrodes 18 and 20 are located inside of extensions 19 and 21, respectively, of enclosure 10. Alternatively, extensions 19 and 21 may be eliminated and electrodes 18 and 20 may be disposed within the main body of enclosure 10. In the embodiment shown in FIG. 6, electrodes 18 and 20 are disposed in extensions 19' and 21' of an enclosure 10', wherein extensions 19' and 21' extend outward from the outer wall 14' of enclosure 10'.

The double walled enclosure provides several advantages. For example, the double Walls 12 and 14 can be provided so as to form a generally hollow cylindrical or torus shaped enclosure. The enclosure may be formed with a large diameter D if desired, without loss of the visible display generated by the discharge. In fact, the double walls 12 and 14 allow a great degree of flexibility in choosing the size of the diameter D of the enclosure without compromising the visual effect of the discharge display. That is, the visible discharge always occurs within the spacing S defined between walls 12 and 14. This spacing S can be relatively narrow (e.g. in the range of ¼ inch to 3 inches, or any desired width) independent of the size of the diameter D of enclosure 10. An enclosure having a large diameter D may define a spacing S equal to the spacing S of another enclosure having a much smaller diameter.

Since the discharge occurs between walls 12 and 14, spacing S controls the range of distances from outer wall 14 at which the discharge path may occur. When the discharge occurs relatively near wall 14, the discharge will be readily visible at a high intensity when viewed through outer wall 14 from outside of enclosure 10. Thus, enclosure 10 may be designed with a spacing S which confines the discharge within a highly visible range of distances near outer wall 14. Alternatively, enclosure 10 may be designed with a spacing S which allows the discharge path to occur in various paths over a relatively wide range of distances from outer wall 14, if desired.

Figure 2:
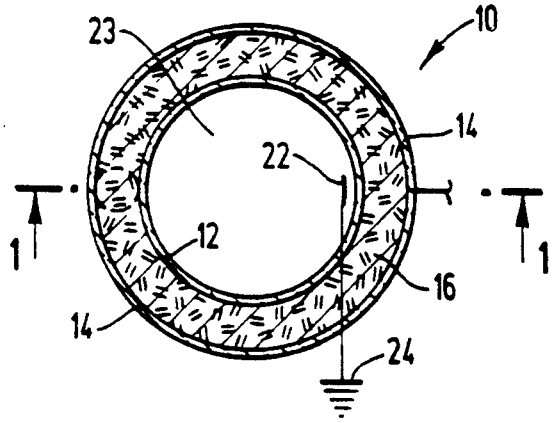
FIG. 2 is a cross section view of the enclosure according to the embodiment shown in FIG. 1.

The hollow double walled enclosure provides another advantage in that electrostatic attraction is increased due to the greater surface area provided by the both the inside and the outside walls 12 and 14. According to an embodiment of the invention, this increased electrostatic attraction allows tailoring the display towards a preferred direction with the use of an electrostatic grounding conductor. In FIG. 2, an electrostatic grounding conductor 22 is placed, for example, inside the torus at a location between one end of the discharge path and the other. Grounding conductor 22 is electrically grounded at 24. The path of the discharge will tend to be drawn toward grounding conductor 22 and the portion of wall 12 adjacent conductor 22. Accordingly, by locating grounding conductor 22 adjacent a wall of enclosure 10, such as inner wall 12, the discharge path may be tailored to occur within the enclosure and near grounding conductor 22. In this manner, the location of the discharge path may be tailored to occur e.g. near the front (or more visible) portion of the display device. Yet another advantage provided by the hollow double walled enclosure is that the structure may be formed such that the hollow interior 23 is readily accessible, e.g. for allowing the grounding conductor 22, back lighting device (not shown) or other structures to be arranged and readily accessible within hollow interior 23.

According to an embodiment of the invention, the grounding conductor may be a conventional gas filled (e.g., neon) discharge tube. The conventional gas filled discharge tube may be employed for providing double functions, functioning as a discharge attracting conductor as well as a back illuminator for providing a background light and/or color against which the "crackling display" is contrasted.

Embodiments of the invention are provided with protrusions 26 located within spacing S of enclosure 10. Protrusions 26 separate the electrodes 18 and 20 from the portion of the enclosure in which filling material 16 is located. By prohibiting filling material 16 from contacting electrodes 18 and 20, damage to the electrodes and electrode sputtering can be avoided, thereby increasing the operational life of the electrodes and the display device.

As shown in FIG. 1, an alternating electric signal from high voltage signal source 30 is connected across electrodes 18 and 20 in a well known manner. Signal source 30 can be of any suitable construction. As an example, a high voltage constant current transformer (e.g. for receiving a 110 volt, 60 cps signal across its primary windings and for providing a 1500 to 15,000 volt alternating current signal across its secondary windings) is shown in FIG. 1. The alternating signal causes an electric discharge to occur within enclosure 10 and to reverse directions during each period of the alternating signal. With each reversal of direction, the discharge establishes a new path through filling material 16 from one electrode to the other. This continuous discharge and reestablishment of the discharge path results in a dramatic, lightening-like or electrical crackling visual effect.

Figure 3:
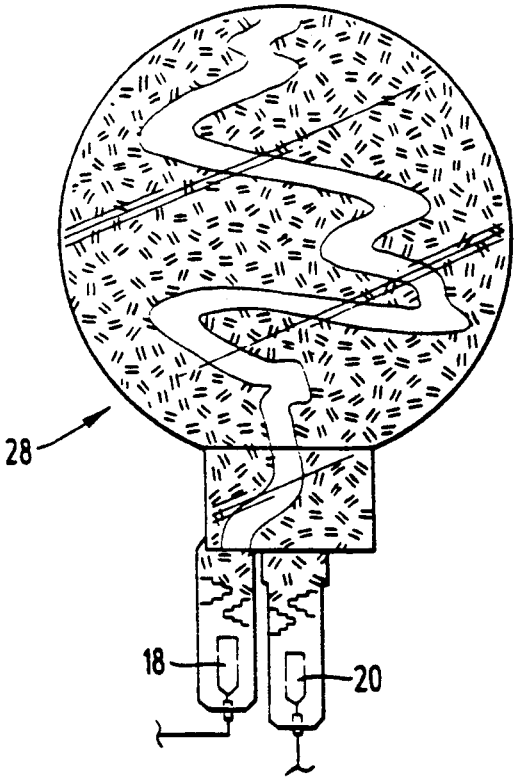
FIG. 3 is a front view of an enclosure according to another embodiment of the present invention.
Figure 4:
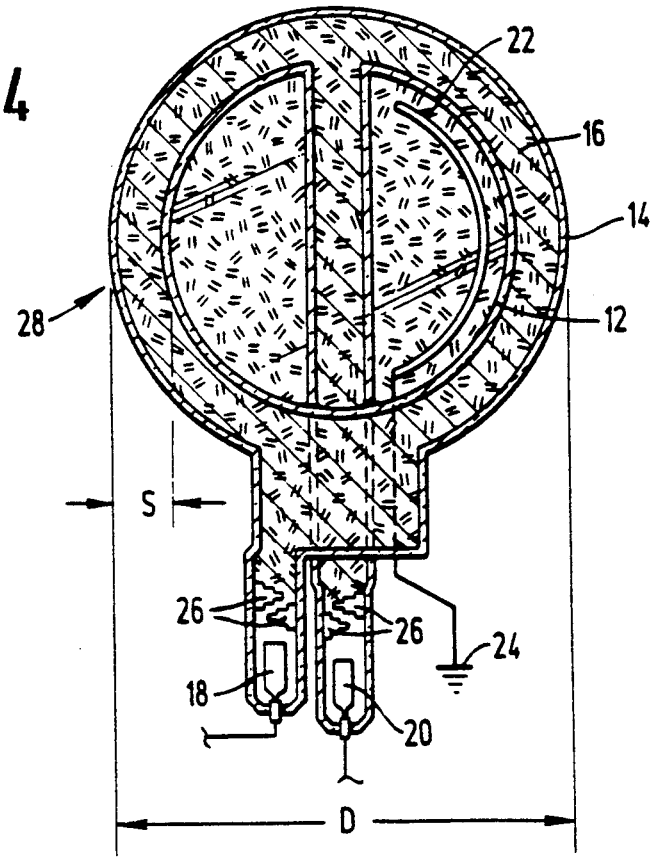
FIG. 4 is a cross section schematic view of the enclosure according to the embodiment shown in FIG. 3.
Figure 5:
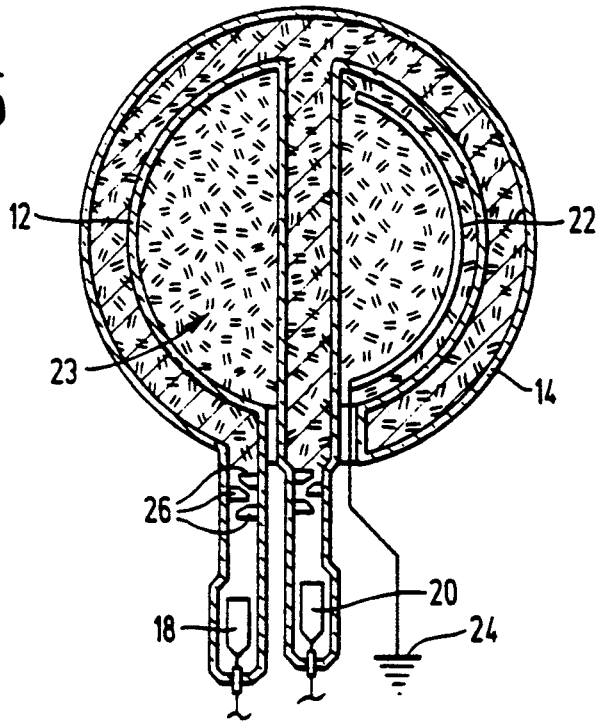
FIG. 5 is a cross section schematic view of an enclosure according to yet another embodiment of the invention.

While the embodiment shown in FIGS. 1 and 2 employ a generally hollow cylindrical or torus-shaped enclosure 10, it will be appreciated that other shapes may be employed for the double walled enclosure. For example, FIGS. 3, 4 and 5 show a generally hollow spherical-shaped enclosure 28. Like elements in FIGS. 1-5 are provided with like numerals. Other shaped enclosure having a double walled structure are also considered to be within the present invention.

According to an embodiment of the invention, a display device may be made by the following method. A double walled enclosure is formed with a diameter D and a spacing S, as desired. The double walled enclosure is evacuated, for example, by employing an oil free turbine pump for two hours at about 800° F. or until the vacuum pressure reaches about $1\times10-7$ torr. This effects an elimination, or at least a minimization, of impurities inside of the enclosure. Impurities cause an increase in sputtering of the electrodes which results in a reduction of chamber pressure and a shortening of the useful life of the display device.

A dielectric filling material is chosen, e.g., from the materials described above or from other suitable materials. According to an embodiment of the invention, the filling material comprises a borosilicate glass. Preferably, the filling material (e.g., the borosilicate glass) is prepared in a manner, such as described below, which minimizes impurities in the material. By minimizing impurities, the operational life of the display device can be increased, as discussed above.

According to an embodiment of the invention, the filling material (e.g., the borosilicate glass) is purified. The filling material is cut to a desired size or shape with a water lubricated diamond saw. The cut filling material is washed with suitable laboratory cleaning agents. The washed filling material is subjected to an, e.g., 10% hydrofluoric bath. The filling material is rinsed with distilled water and baked before use. Preferably, the resulting purified filling material exhibits extremely low out-gassing characteristics after purification. The filling material is then placed within the enclosure, between the double walls.

The enclosure is filled with an ionizable gas, e.g., chosen from the inert gasses discussed above or from other suitable gasses. Preferably, the gas is 99.999% pure so as to avoid impurities which reduce the operational life of the display device.

Electrodes are positioned in communication with the interior of the enclosure, e.g. at opposite ends of the enclosure. Preferably, Svea metal electrodes are employed. However, other suitable electrodes may be used. In preferred embodiments, traps (e.g. traps 26) are positioned between the electrodes and the filling material. The traps may be formed during the enclosure forming step or, alternatively, may be separate members inserted in the enclosure in another step.

A source of a high voltage alternating electric signal is connected across the electrodes. As discussed above, in operation the alternating signal causes plural discharges, wherein the discharge reverses direction during each period of the alternating signal, e.g., 120 times per second. In each period of the alternating signal, the gas is re-ionized and the discharge establishes a new path from one electrode to the other. This constant reestablishment of the paths causes a flickering display that is quite dramatic and seemingly random.

As discussed above, this dramatic visual display may be tailored to occur, e.g. relatively near the outer wall of the enclosure (for example, by designing the spacing S for such a feature) and/or at specific portions of the enclosure (for example, by employing a grounding conductor to draw the discharge toward the specific portion of the enclosure). The double walled enclosure has a relatively large surface area which, in conjunction with the grounding conductor, provides a relatively large electrostatic ground for drawing the discharge toward a desired portion of the enclosure. The double walled enclosure also provides efficient cooling capabilities which increase the operational life of the device. The operational life of the display device can be further increased by employing traps for prohibiting the filling material from contacting the electrodes and/or by employing manufacturing techniques for minimizing impurities within the enclosure. As a result, a display device may be made which provides a significantly improved visual discharge display and which exhibits a relatively long operational life (with respect to conventional gas discharge display devices).

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A display device comprising:

a gas filled double walled enclosure having first and second walls and a space between the first and second walls, the enclosure having a hollow interior which is separated from the space between the walls by the first wall, the enclosure containing an ionizable gas in the space between the first and second walls;

a pair of electrodes disposed in electrical communication with the gas contained in the enclosure; and an electrical signal source for applying an electrical signal across the electrodes for ionizing the gas within the enclosure to provide an electrical discharge along a path from one electrode to the other;

a grounding conductor disposed adjacent at least one of the first and second walls and within a proximity of the wall to draw the electrical discharge in the direction toward the conductor.

2. A discharge display device as claimed in claim 1, wherein the electrical source applies an alternating electrical signal which causes the electrical discharge to reestablish and reverse directions during each period of the alternating signal.

3. A display device as claimed in claim 1, wherein the enclosure is shaped generally as a hollow cylinder.

4. A display device as claimed in claim 1, further comprising dielectric filling material disposed within the enclosure, in the space between the first and second walls.

5. A display device as claimed in claim 1, wherein the grounding conductor comprises an electrostatically grounded metal conductor.

6. A display device as claimed in claim 5, wherein the metal conductor is disposed within the hollow interior of the enclosure.

7. A display device as claimed in claim 1, wherein the grounding conductor comprises a gas filled electrical discharge tube.

8. A display device as claimed in claim 7, wherein the gas filled electrical discharged tube is disposed within the hollow interior of the enclosure.

9. A display device as claimed in claim 1, wherein the ionizable gas comprises at least one of the gasses of the group consisting of inert gasses.

10. A display device as claimed in claim 1 wherein the ionizable gas comprises neon.

11. A display device as claimed in claim 1, wherein the ionizable gas is 99.999% pure.

12. A display device as claimed in claim 1, wherein the grounding conductor is disposed within the hollow interior of the enclosure.

13. A display device comprising:

a gas filled double walled enclosure having first and second walls and a space between the first and seconds walls, the enclosure having a hollow interior which is separated from the space between the walls by the first wall, the enclosure containing an ionizable gas in the space between the first and seconds walls;

a pair of electrodes disposed in electrical communication with the gas contained in the enclosure; and an electrical signal source for applying an electrical signal across the electrodes for ionizing the gas within the enclosure to provide an electrical discharge along a path from one electrode to the other;

the display device further comprising a grounding conductor disposed adjacent the first wall and within the hollow interior of the enclosure, within a proximity of the first wall to draw the electrical discharge in the direction toward the conductor.

14. A display device comprising:

a gas filled double walls enclosure having first and second walls and a space between the first and seconds walls, the enclosure having a hollow interior which is separated from the space between the walls by the first wall, the enclosure containing an ionizable gas in the space between the first and seconds walls;

a pair of electrodes disposed in electrical communication with the gas contained in the enclosure; and an electrical signal source for applying an electrical signal across the electrodes for ionizing the gas within the enclosure to provide an electrical discharge along a path from one electrode to the other;

wherein the electrodes are disposed within the enclosure, the device further comprising trap means, disposed between each electrode and the filling material, for inhibiting the filling material from contacting the electrodes.

15. A display device comprising:

a gas filled double walled enclosure having first and second walls and a space between the first and seconds walls, the enclosure having a hollow interior which is separated from the space between the walls by the first wall, the enclosure containing an ionizable gas in the space between the first and seconds walls;

a pair of electrodes disposed in electrical communication with the gas contained in the enclosure; and an electrical signal source for applying an electrical signal across the electrodes for ionizing the gas within the enclosure to provide an electrical discharge along a path from one electrode to the other;

wherein the electrodes are disposed within the enclosure, the device further comprising projections disposed between each electrode and the filling material for inhibiting the filling material from contacting the electrodes.

* * * * *